US005572842A

United States Patent [19]

Stief et al.

[11] Patent Number: 5,572,842

[45] Date of Patent: Nov. 12, 1996

[54] HOLLOW FLOOR

[75] Inventors: Reinhard Stief, Weinheim; Manfred Wagner, Gorxheimertal; Hans Heckmann, Weinheim, all of Germany

[73] Assignee: Firma Carl Freudenberg, Weinheim, Germany

[21] Appl. No.: 495,250

[22] Filed: Jun. 27, 1995

[30] Foreign Application Priority Data

Oct. 7, 1994 [DE] Germany ..... 44 35 895.4

[51] Int. Cl.[6] ..... E04B 5/00

[52] U.S. Cl. ..... 52/403.1; 52/404.4; 52/220.3; 52/144; 52/309.12

[58] Field of Search ..... 52/220.3, 220.4, 52/404.1, 404.4, 403.1, 263, 144, 309.8, 309.12, 209.17, 408, 409, 332, 335, 336, 447

[56] References Cited

U.S. PATENT DOCUMENTS

| | | | |
|---|---|---|---|
| 3,382,637 | 5/1968 | Longinotti | 52/309.12 X |
| 3,440,787 | 4/1969 | Bataille | 52/408 X |
| 3,597,891 | 8/1971 | Martin | 52/145 |
| 4,800,697 | 1/1989 | Oswald | 52/447 X |
| 4,924,645 | 5/1990 | Abeln | 52/404.1 X |
| 4,945,697 | 8/1990 | Ott et al. | 52/403.1 |
| 4,993,202 | 2/1991 | Thiel | 52/630 X |
| 5,042,569 | 8/1991 | Siegmund | 52/220.3 X |
| 5,199,240 | 4/1993 | Ewald | 52/309.12 X |
| 5,277,010 | 1/1994 | Stephenson et al. | 52/403.1 |

*Primary Examiner*—Robert Canfield
*Attorney, Agent, or Firm*—Kenyon & Kenyon

[57] ABSTRACT

A hollow floor composed of a profiled false floor (1) which is arranged between a top floor (2) and a sub floor (3) and is designed to be plate-shaped, the false floor (1) having cup-shaped depressions (4) that are joined together by essentially flat edge areas (5). The depressions (4) are filled in with a sound-deadening filler material (6).

17 Claims, 4 Drawing Sheets

FIG. 4A
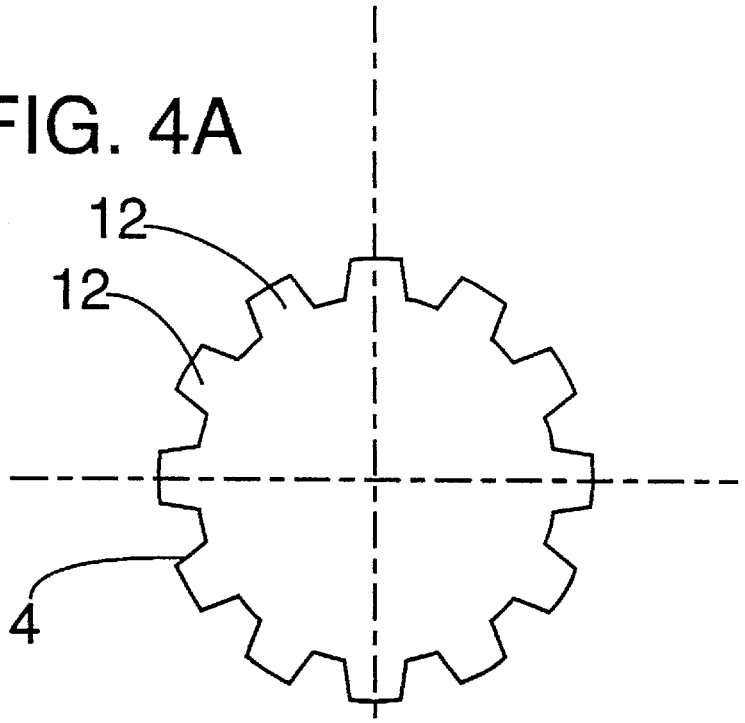
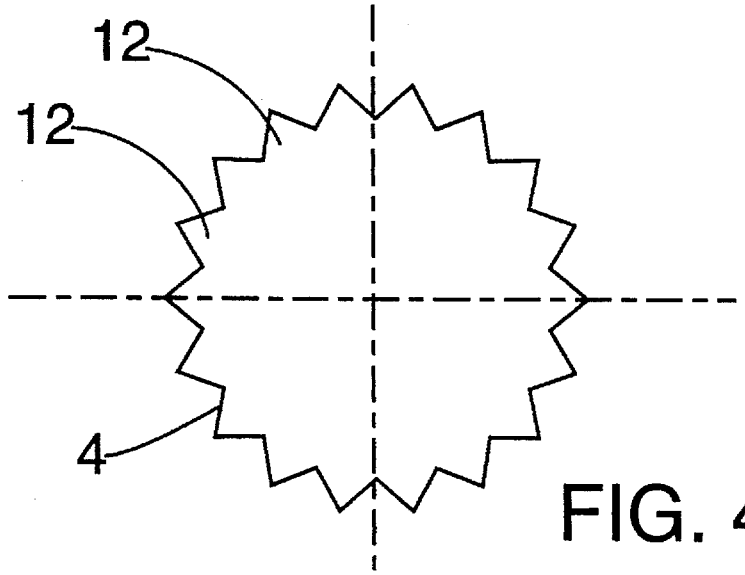
FIG. 4B

HOLLOW FLOOR

BACKGROUND OF THE INVENTION

1. Field of the Invention

The invention relates to a hollow floor comprising a profiled false-intermediate floor which is arranged between a top floor and a sub floor and is designed to be plate-shaped, the false floor having cup-shaped depressions that are joined together by essentially flat edge areas.

2. Description of Related Art

A hollow floor of this type is known from U.S. Pat. No. 4,993,202. This hollow floor has a profiled floor sheeting having truncated-cone-shaped supports that is filled in and covered by floor fill, the floor sheeting accommodating irregularities in the sub floor and being walkable. The floor sheeting constitutes a framework for the floor fill material to be applied which forms the top floor. The floor sheeting is designed to be plate-shaped and as thin as possible so that mutually adjacent sheeting plates can be loosely superimposed at their edges without ridges developing in the floor fill layer.

SUMMARY OF THE INVENTION

An object of the invention is to provide a hollow floor of the type described above wherein inner stresses in the floor fill which forms the top floor are avoided and wherein the floor fill has a shorter drying time than the prior art.

A further object of the invention is to provide such a hollow floor which exhibits improved deadening of footfall sound.

These and other objects of the invention are achieved by a hollow floor comprising a profiled intermediate (false) floor which is arranged between a top floor and a sub floor and is designed to be plate-shaped, the intermediate floor having cup-shaped depressions therein that are joined together by essentially flat edge areas, wherein the depressions (4) are filled in with a sound-deadening filler material (6).

BRIEF DESCRIPTION OF DRAWINGS

An exemplified embodiment of the hollow floor according to the invention will be explained in greater detail with reference to FIG. 1 through FIG. 4.

In FIGS. 4A and 4B two exemplary embodiments are shown for the construction of stiffening ribs which extend along the height of the depressions and are uniformly distributed in circumferential direction.

DETAILED DESCRIPTION OF THE INVENTION

Figure 1:
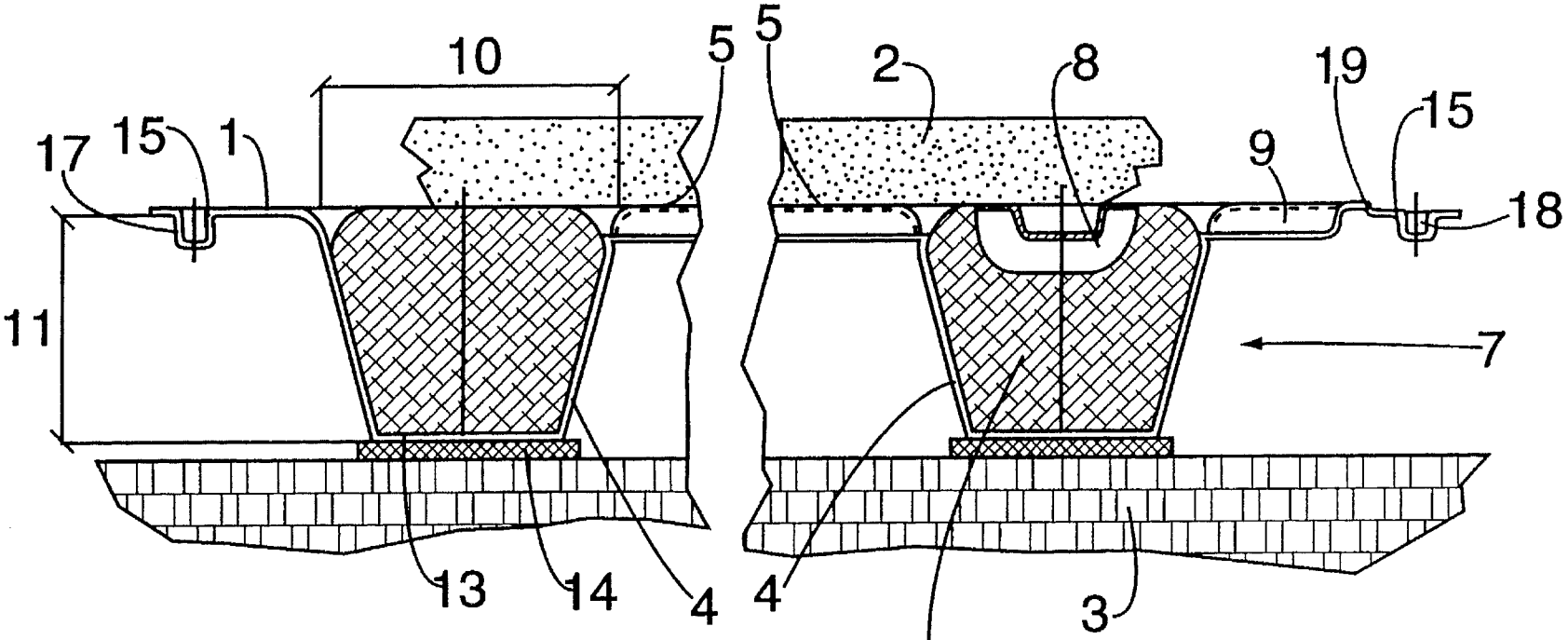
In FIG. 1, a cut-away portion of a hollow floor is shown in cross-sectional representation.

Within the framework of the invention, the depressions are filled in with a sound-damping filler material. Because the depressions of the false floor are not filled in with the floor fill forming the top floor, but rather with a sound-damping filler material, the drying time of the floor fill is markedly reduced due to the avoidance of material accumulations in the area of the depressions. Inner stresses within the floor fill are also reliably avoided. A transmission of disturbing footfall noise from the top floor onto the sub floor is substantially reduced by the depressions filled in with the sound-damping filler material.

The sub floor is made up mostly of concrete upon which, with the addition between of the false floor, liquid floor fill material is applied to produce the top floor. To produce a top floor with a smooth surface, it is advantageous if the false floor is walkable in order to be able to smooth out the viscous floor fill material if necessary.

According to one advantageous refinement, the false floor is formed by a floor sheeting of polymer material which is manufacturable preferably by deep drawing.

The filler material within a depression preferably has a load-bearing capacity of at least 4000N. In this manner the walkability of the floor sheeting is assured even when its thickness is less than 1 mm. The filler material has a good inherent rigidity and can therefore accommodate high loads. The force acting on the false floor is carried substantially by the filler material.

The filler material can be held in the depressions adhesively and/or with a positive fit. For example, the filler material may be introduced in the fluid state into the depressions so that the filler material grabs with the adjacent surfaces of the floor sheeting when hardening. In this way, the filler is held in its position with a positive fit.

In order to produce a thickness of the floor fill that is as uniform as possible and an identical drying time of the entire top floor associated with this uniformity of thickness, and thereby avoid inner stresses, according to one advantageous refinement of the invention the filler material and the edge areas adjacent to the openings of the depressions are formed flush with the surface. In addition, the walkability of the false floor is substantially facilitated by such a refinement. In laying the false floor on the sub floor, the advantage of an essentially flat surface is to be stressed.

To improve their dimensional stability, the edge areas can each be provided with at least one stiffening corrugation (e.g., a reinforcing seam or crimp) preferably two crimps being used which cut through each other in an angle of essentially 90°. In addition to improved walkability, the 14 laying of the false floor on the sub floor is simplified by the increased dimensional stability.

The filler material is composed preferably of a PU [polyurethane fiber] foam. The bulk density of the filler material for most applications is 50 to 120, preferably 60 to 100 $kg/m^3$. Such a filler material has a comparatively high load-bearing capacity, prevents the leakage of floor fill into the depressions and results in good deadening of footfall sound when walking on the hollow floor. The filler material can also be formed, for instance, by a rubber cork body formed in one piece which in each case is inserted in a depression and bonded to it, for example adhesively. The rubber cork bodies consist preferably of recycling components which are pressed together. In this connection, it is advantageous that, from an economic standpoint, the false floor is able to be produced inexpensively.

According to one advantageous refinement of the false floor, the depressions are each identically designed and the ratio of the largest diameter to height is 0.6 to 1.8, preferably 0.8 to 1.2. Because of the essentially quadratic layout of the depressions, viewed in cross-section, the false floor has a high degree of load carrying capacity. Even with the introduction of transverse forces, for example when walking on the false floor to apply the floor fill, a buckling of the depressions is reliably avoided.

A further improvement in the mechanical stability and load carrying capacity can be achieved by designing the depressions to have a truncated-cone shape and providing them with stiffening ribs which extend along the entire height of the depressions and are uniformly distributed in circumferential direction. In addition, because of the depressions tapered in a truncated-cone shape in the direction of the sub floor, a relatively enlarged hollow space is formed for the laying of connecting cables and hoses in comparison to the essentially cylindrically designed depressions. By means of the stiffening ribs distributed uniformly in circumferential direction, the material thickness of the false floor, in the case of specified minimum load-bearing capacity, can be further reduced.

To improve the deadening of footfall sound, a footfall sound damper can be arranged in each case on the side of the bottoms of the depressions facing away from the openings. Furthermore, it is advantageous that slight irregularities in the sub floor can be compensated for by the elastic flexibility of the footfall sound damper. By the arrangement of the footfall sound dampers, uncoupling of footfall sound or sound conducted through solids is achieved, since the floor sheeting contacts only the floor fill in an adjoining manner. The entire false floor and the top floor formed by the floor fill are supported only by the footfall sound dampers on the sub floor.

The footfall sound dampers consist preferably of a closed-cell foam body with a bulk density of 20 to 60, preferably 25 to 50 kg/m$^3$, and have a pore count of at least 50, preferably 70 ppi. ppi indicates the pore count for a 1-inch length. By means of footfall sound dampers developed in such a way, in a test, a footfall sound correction standard of $\Delta Lw=35$ dB was achieved, in accordance with DIN 52210-T, with a 40 mm thick floor fill overlay as the top floor.

The footfall sound damper essentially covers the bottom of the depression completely. The footfall sound damper preferably has the shape of a regular hexagon. Because of its complete covering of the bottom, it is advantageous that the footfall sound damper is subjected to only a comparatively modest compressive load per unit area and therefore the manifestations of relaxation impairing the deadening of footfall sound are avoided. The shape of the regular hexagon is particularly advantageous economically and from a standpoint of production engineering. Because of the hexagonal geometry, the footfall sound dampers can be manufactured absolutely without waste. The footfall sound dampers are preferably stuck on the bottom of the depressions of the false floor and have a thickness of at least 2, preferably of at least 5 mm. The good working properties of the false floor with regard to the separation of footfall sound are retained by this means during the entire service life.

The false floor can be formed by at least two separately produced individual elements which are able to be secured together in position by means of at least one fixing device. By the utilization of a plurality of individual elements, which in their totality form the false floor, the laying of the false floor and its ability to be handled is substantially simplified. According to one advantageous refinement, the individual elements can have over-all dimensions which correspond to the European pallet dimension so that an optimum utilization of transport surface can be assured when loading a heavy goods vehicle and/or train.

The fixing device can be formed by a press-fastener system in which at least one cup-shaped convexity of the first individual element is able to be forced into engagement with at least one congruently shaped depression or recess in the second individual element. In the area of the overlapping of convexity and depression or recess, the partial area of the overlap of one of the individual elements facing the sub floor can be provided with a shoulder running essentially at right angles which corresponds in its thickness to the material thickness used in the partial area of the individual element that is facing the top floor. After the laying of the individual elements to make the false floor, the surface of the individual elements form a flat surface so that the floor fill applied afterwards has a constant thickness.

Referring to FIG. 1, a cut-away portion of a hollow floor is shown in a cross-sectional view. The hollow floor is made up of a top floor 2 formed as floor fill which is supported on a sub floor 3 made of cement by means of a false [intermediate] floor 1 in a manner that footfall sound is neutralized. In this exemplary embodiment, the false floor consists of a plurality of individual elements 1.1, 1.2 which are formed as deep-drawn floor sheetings. The floor sheeting 7 has a multitude of cup-shaped depressions 4 which are joined flush with the surface by an essentially flat edge area 5 adjacent to the openings 8 of the depressions 4. The depressions 4 are filled in with a sound-deadening filler material 6 which, in this exemplary embodiment, consists of a PU-foam and has a bulk density of 80 kg/m$^3$. The foam has a good inherent rigidity and can accommodate a load of about 4000N per depression 4. On the inner side facing the filler material 6, the depressions 4 have a surface profiling with which the filler material 6 grabs during its hardening, producing a positive fit. The depressions 4 in this exemplary embodiment are dimensioned in such a way that the ratio of the largest inside diameter 10 of the depression 4 to the height 11 amounts to one. On the side facing the sub floor 3, the floor sheeting 7 is provided with footfall sound dampers 14 which are bonded adhesively to the bottoms 13 of the depressions 4. The platelike footfall sound dampers 14 consist of a closed-cell plastic body and cover the bottom 13 along substantially its entire extension. The filler material 6 within the depressions 4 extends up to the area of the openings 8 of the depressions 4 and ends flush with the edge areas 5. Stiffening corrugations 9 in the edge area 5 which are marked with the reference numeral 9 are provided to improve the dimensional stability of the false floor 1.

Figure 2A:
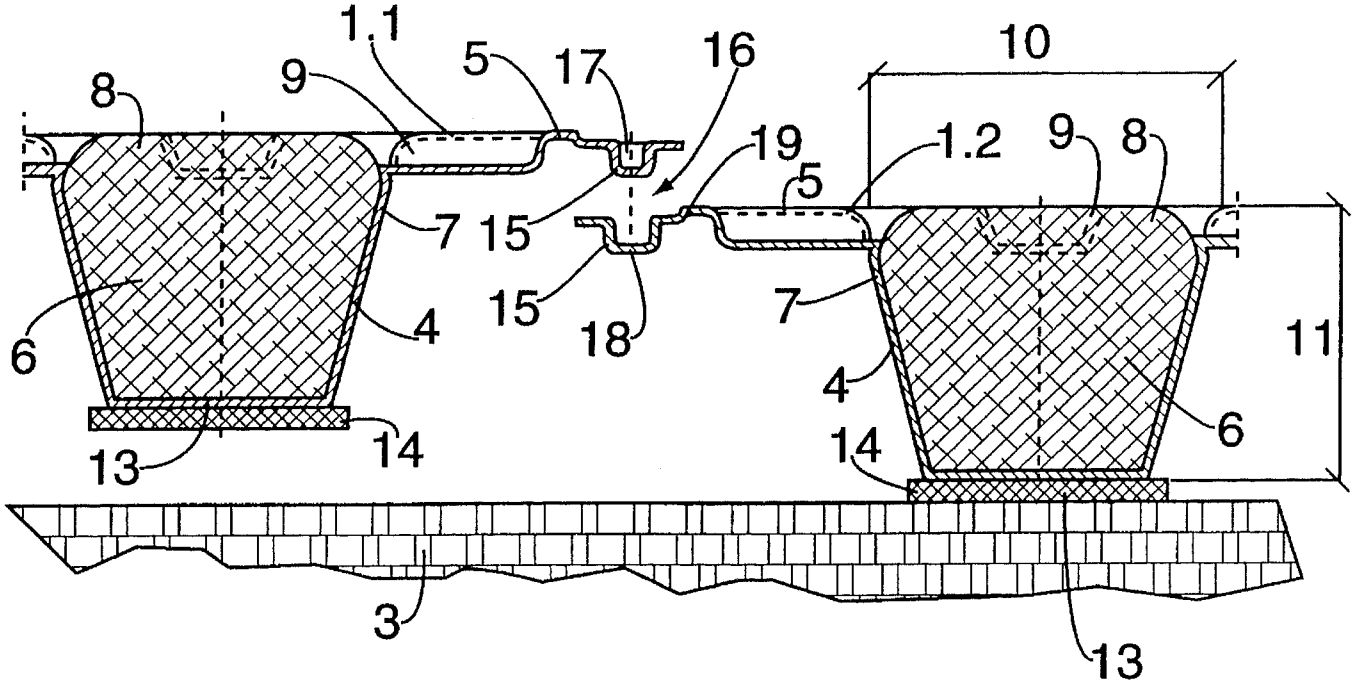
In FIG. 2A, the false floor of the hollow floor from FIG. 1 is shown in cross-section as a component part, with two mutually adjacent individual elements of the false floor being shown before their assembly.

In FIG. 2A, a cut-away portion of two individual elements 1.1, 1.2 is shown which are able to be secured together in position with positive locking in their edge area 5 by means of a fixing device 15. The fixing device 15 is formed by a press-fastener system 16, the first individual element 1.1 being provided with a convexity 17 pointing in the direction of the sub floor 3 that is able to be snapped with positive locking into a depression or recess 18 of the second individual element 1.2 open in the direction of the top floor 2. The second individual element 1.2 has a shoulder 19 running at right angles which corresponds to the material thickness of the edge area 5 of the first individual element 1.1. After the joining of the two individual elements 1.1, 1.2, the surface of the false floor 1 facing the top floor 2 forms a flat surface.

Figure 2B:
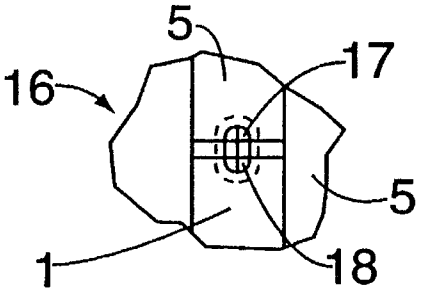
In FIG. 2B is shown a detailed, isolated top view of a press-fastener system used to join individual elements of the intermediate floor of the invention.

In the separate, detailed, isolated view in FIG. 2B, the press-fastener system 16 is shown in a top view. It should be recognized that the depression or recess 18 of the second individual element 1.2 is formed as an elongated hole, while the convexity 17 of the first individual element 1.1 has a circular shape. In joining the convexity 17 with the depression or recess 18, variations in dimension dependent on manufacture can be compensated for.

After all the individual elements 1.1, 1.2 are joined to form the false floor 1, the floor fill is distributed over the surface of the false floor 1 and forms the top floor 2.

Figure 3:
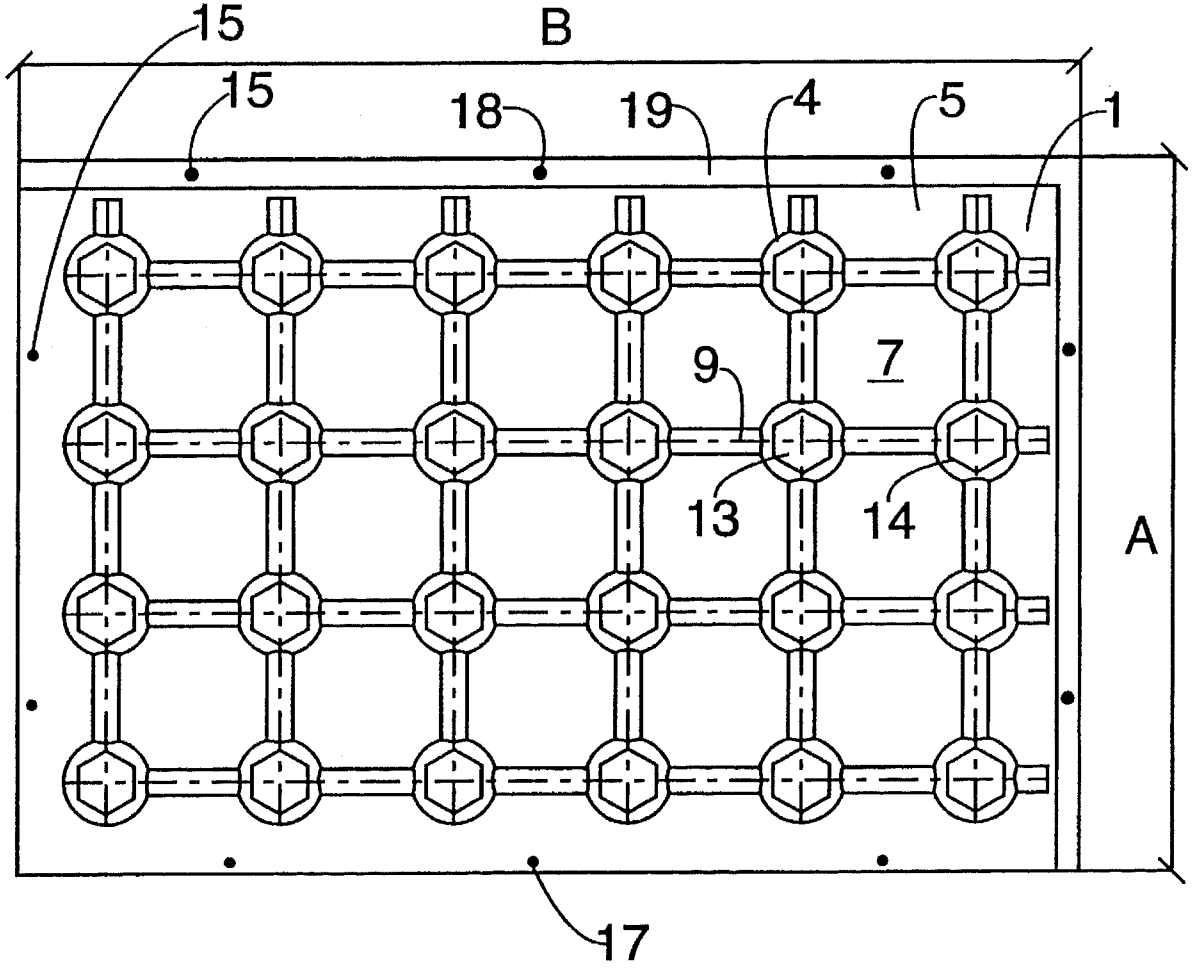
In FIG. 3, the false floor is shown in a view from the direction of the sub floor.

In FIG. 3, the individual element 1.1, having a length A and a width B, is shown in a view from the sub floor 3. Near the periphery of the individual element 1.1, convexities 17 and depressions or recesses 18 are arranged which form a part of the press-fastener system 16. Between the depressions 4, stiffening corrugations 9 are arranged which cause an improved dimensional stability of the false floor 1. The footfall sound dampers cover substantially the entire bottom 13 of the depressions 4 and are designed in the shape of a regular hexagon. The footfall sound dampers 14 consist of a closed-cell foam body and are bonded to the bottom 13.

In FIG. 4A and 4B, two examples of possible cross-sections of the depressions 4 are shown. In FIG. 4A, the truncated-cone-shaped depressions 4 have stiffening ribs 12 that extend along the entire height 11 of the depressions 4 and are uniformly distributed in circumferential direction. In FIG. 4A, the stiffening ribs 12 are designed essentially 14 trapezoidal-shaped; in FIG. 4B, the stiffening ribs 12 have an essentially triangular cross-section. The load-bearing capacity of the false floor 1 is considerably increased by the stiffening ribs 12.

What is claimed is:

1. A hollow floor comprising a profiled intermediate floor which is arranged between a top floor having a flat upper surface and a sub floor and is designed to be plate-shaped, the intermediate floor having cup-shaped depressions therein, each depression extending from a bottom side to a top open end, the depressions being joined together by essentially flat edge areas disposed around the open ends of the depressions, wherein the depressions (4) are filled in with a sound-deadening filler material (6) up to the open ends thereof and the edge areas are flush with a top level of the filler material, the sound-deadening filler material being selected from the group consisting of polyurethane and rubber.

2. The hollow floor according to claim 1, wherein the intermediate floor (1) is a floor sheeting (7) made of polymer material.

3. The hollow floor according to claim 1, wherein the filler material (6) in the depressions (4) has a load-bearing capacity of at least 4000N.

4. The hollow floor according to claim 1, wherein the filler material (6) is held in the depressions (4) adhesively.

5. The hollow floor according to claim 1, wherein the edge areas (5) are provided with at least one stiffening corrugation (9) which enhances dimensional stability.

6. The hollow floor according to claim 1, wherein the filler material (6) is composed of polyurethane foam and has a bulk density of 50 to 120 kg/m$^3$.

7. The hollow floor according to claim 1, wherein the filler material (6) is rubber cork bodies formed in one piece.

8. The hollow floor according to claim 1, wherein the depressions (4) are each identically shaped and wherein each depression has a ratio of its largest diameter (10) to its height (11) of from 0.6 to 1.5.

9. The hollow floor according to claim 1, wherein each depression (4) has a truncated-cone shape and is provided with stiffening ribs (12) distributed circumferentially around the depression, the stiffening ribs extending along the entire height (11) of the depression (4).

10. The hollow floor according to claim 1, further comprising a footfall sound damper (14) arranged on a bottom side (13) of each of the depressions (4) facing away from the open ends (8) of the depressions.

11. The hollow floor according to claim 10, wherein the footfall sound damper (14) consists of a closed-cell foam with a bulk density of 20 to 60 kg/m$^3$ and has a pore count of at least 50 ppi.

12. The hollow floor according to claim 11, wherein the footfall sound damper (14) essentially covers the bottom side (13) which it is arranged on completely and has a shape of a regular hexagon.

13. The hollow floor according to claim 11, wherein the footfall sound damper (14) has a thickness of at least 2 mm.

14. The hollow floor according to claim 1, wherein the intermediate floor (1) is comprised of at least two separately produced individual elements (1.1, 1.2) which are secured together in position by at least one fixing means (15).

15. The hollow floor according to claim 14, wherein the fixing means (15) includes a press-fastener system (16) in which a cup-shaped convexity (17) of the first individual element (1.1) is able to be forced into engagement with positive locking with a congruently formed depression or recess (18) of the second individual element (1.2).

16. A hollow floor comprising a profiled intermediate floor disposed between a top floor and a sub floor, the intermediate floor having cup-shaped depressions therein which are joined together by essentially flat edge areas, the flat edge areas having at least one stiffening corrugation which enhances dimensional stability of the floor, wherein the depressions are filled with a sound-deadening filler material.

17. A floor comprising a profiled intermediate floor disposed between a top floor and a sub floor, the intermediate floor having cup-shaped depressions therein which are joined together by essentially flat edge areas, wherein the depressions are filled with a sound-deadening filler material, and the intermediate floor being comprised of a plurality of individual floor elements which are secured together in position by press-fastener means, said press-fastener means including a convex member belonging to a first individual element of the intermediate floor and a congruently shaped recess defined in a second individual element of the intermediate floor, the convex member being press-fit in the recess.

* * * * *

UNITED STATES PATENT AND TRADEMARK OFFICE

CERTIFICATE OF CORRECTION

PATENT NO. : 5,572,842

DATED : November 12, 1996

INVENTOR(S): STIEF et al.

It is certified that error appears in the above-identified patent and that said Letters Patent is hereby corrected as shown below:

Column 6, line 23, change "claim 11" to --claim 10--;

Column 6, line 43, change "A floor" to --A hollow floor--.

Signed and Sealed this

Seventeenth Day of June, 1997

*Attest:*

*Attesting Officer*

BRUCE LEHMAN

*Commissioner of Patents and Trademarks*